United States Patent [19]

Suggitt

[11] Patent Number: 4,863,489

[45] Date of Patent: Sep. 5, 1989

[54] PRODUCTION OF DEMERCURIZED SYNTHESIS GAS, REDUCING GAS, OR FUEL GAS

[75] Inventor: Robert M. Suggitt, Wappingers Falls, N.Y.

[73] Assignee: Texaco Inc., White Plains, N.Y.

[21] Appl. No.: 305,588

[22] Filed: Feb. 3, 1989

[51] Int. Cl.[4] ..... C10J 3/46

[52] U.S. Cl. ..... 48/197 R; 48/206; 48/210; 252/373; 423/210

[58] Field of Search ..... 48/197 R, 206, 209, 48/215, 196 R, 210; 252/373; 423/210, 215.5, 226, 228, 229; 55/72

[56] References Cited

U.S. PATENT DOCUMENTS

| | | | |
|---|---|---|---|
| 4,044,098 | 8/1977 | Miller et al. | 423/210 |
| 4,081,253 | 3/1978 | Marion | 48/215 |
| 4,088,735 | 5/1978 | Bratzler et al. | 423/228 |
| 4,189,307 | 2/1980 | Marion | 48/197 R |
| 4,196,173 | 4/1980 | de Jong et al. | 423/210 |
| 4,273,747 | 6/1981 | Rasmussen | 55/72 |
| 4,671,803 | 8/1987 | Suggitt | 423/210 |
| 4,781,731 | 11/1988 | Schlinger | 48/197 R |

*Primary Examiner*—Peter Kratz

*Attorney, Agent, or Firm*—Robert A. Kulason; James J. O'Loughlin; Albert Brent

[57] ABSTRACT

A process for the production of demercurized synthesis gas, reducing gas or fuel gas. Mercury-containing fossil fuels e.g. coal were reacted by partial oxidation to produce gaseous mixtures comprising $H_2$, CO, $H_2O$, $CO_2$, $H_2S$, COS, entrained slag and/or ash, mercury vapor, and optionally $CH_4$, $NH_3$, $N_2$ and Ar. Unexpectedly, the mercury vapor was produced in the reaction zone; and it was found to be thermodynamically stable even in the presence of $H_2S$ under the strong reducing conditions that prevailed in the gas generator. No new sulfides of mercury were formed. The mercury vapors were removed from the main body of the process gas stream in a pressurized solvent scrubber at a relatively low temperature. By this means, the mercury vapor was condensed and simultaneously the mercury and sulfur contents of the clean process gas stream were reduced to low levels. In one embodiment, the last vestiges of mercury were removed from the demercurized product gas stream by carbon sorption.

29 Claims, 1 Drawing Sheet

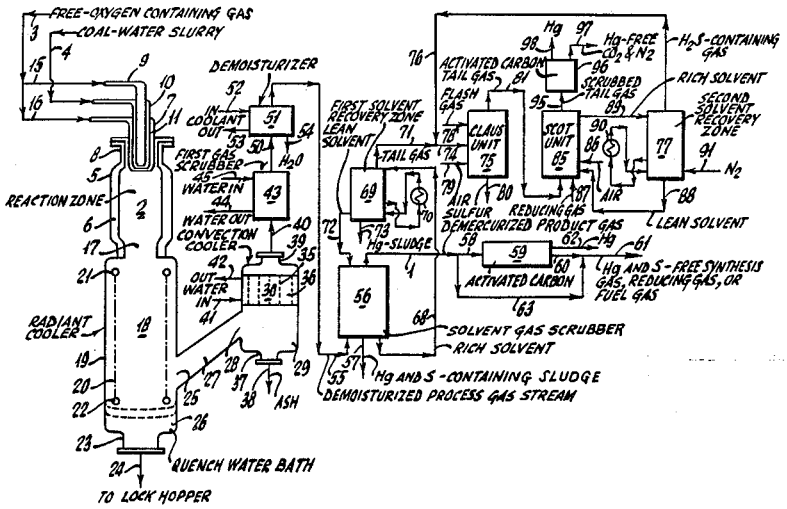

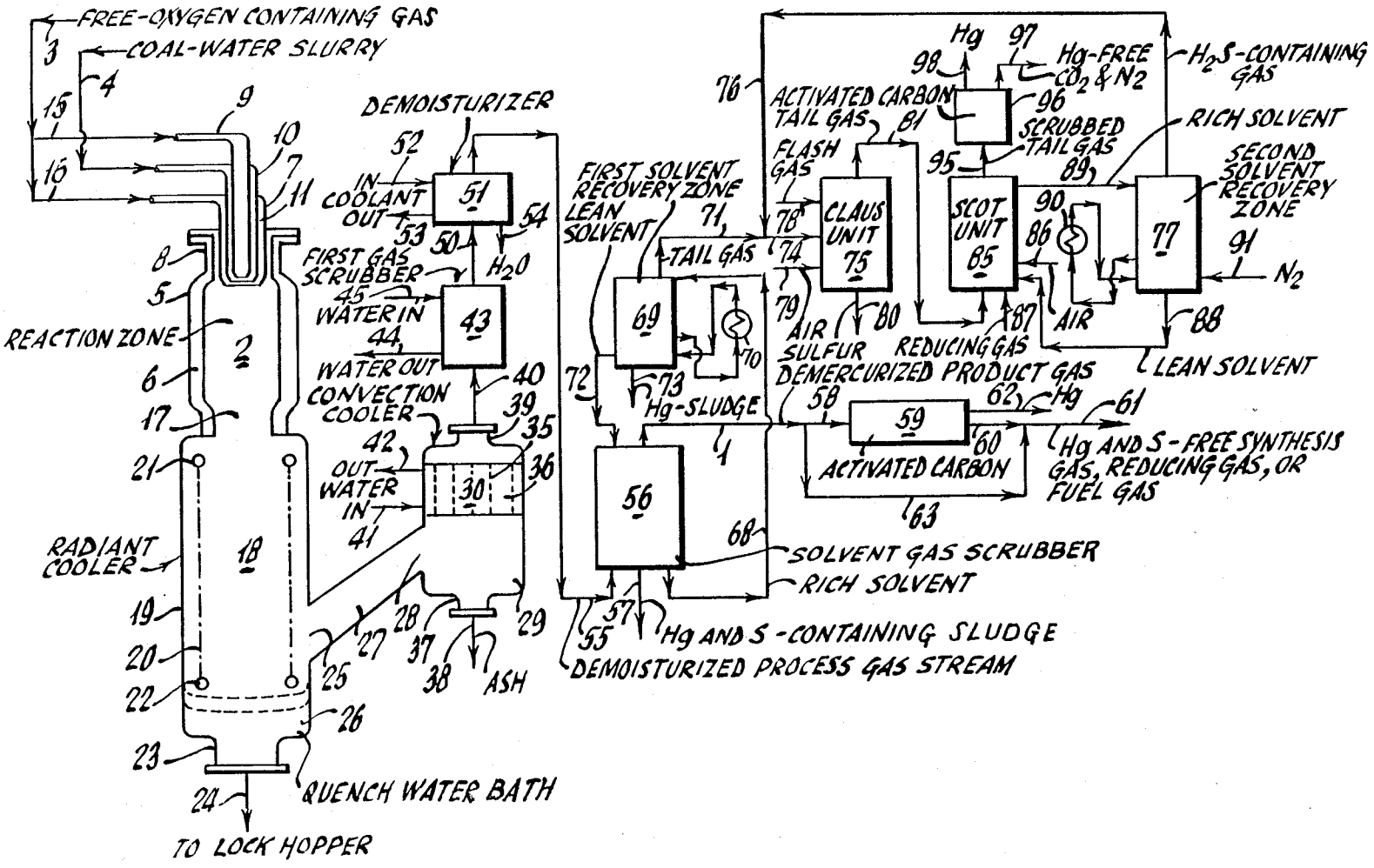
FREE-OXYGEN CONTAINING GAS
COAL-WATER SLURRY
DEMOISTURIZER
IN
COOLANT
OUT
FIRST GAS SCRUBBER
WATER IN
WATER OUT
CONVECTION COOLER
OUT
WATER
IN
ASH
REACTION ZONE
RADIANT COOLER
QUENCH WATER BATH
TO LOCK HOPPER
FIRST SOLVENT RECOVERY ZONE
LEAN SOLVENT
TAIL GAS
Hg-SLUDGE
Hg AND S-CONTAINING SLUDGE
DEMOISTURIZED PROCESS GAS STREAM
SOLVENT GAS SCRUBBER
RICH SOLVENT
ACTIVATED CARBON
REDUCING GAS
DEMERCURIZED PRODUCT GAS
Hg AND S-FREE SYNTHESIS GAS, REDUCING GAS, OR FUEL GAS
SULFUR
AIR
CLAUS UNIT
FLASH GAS
ACTIVATED CARBON TAIL GAS
SCOT UNIT
SCRUBBED TAIL GAS
Hg-FREE $CO_2$ & $N_2$
Hg
$H_2S$-CONTAINING GAS
RICH SOLVENT
SECOND SOLVENT RECOVERY ZONE
$N_2$
LEAN SOLVENT
AIR

PRODUCTION OF DEMERCURIZED SYNTHESIS GAS, REDUCING GAS, OR FUEL GAS

FIELD OF THE INVENTION

This invention relates to a process for producing demercurized synthesis gas, reducing gas, or fuel gas from mercury-containing fossil fuels.

BACKGROUND OF THE INVENTION

Synthesis gas, reducing gas, and fuel gas are gaseous mixtures comprising $H_2$, carbon oxides, $H_2O$, and $CH_4$. Synthesis gas and reducing gas are rich in $H_2$, CO and have varying $H_2/CO$ mole ratios. Fuel gas is rich in $CH_4$ and has a high heat capacity. These gases are commonly made by the gasification of fossil fuels e.g. liquid hydrocarbonaceous fuels such as crude oil, and solid carbonaceous fuels such as coal and petroleum coke. Mercury contamination in the synthesis gas, reducing gas, and fuel gas occurs when the feedstock to the gasifier contains mercury. For example, reported values of mercury concentrations in coal feedstocks range from about 0.012 to 33 ppm (parts per million) with an average value of about 0.2 ppm for certain U.S. coals. When large amounts of coal e.g. about ten thousand tons per day of a coal containing about 0.25 ppm to Hg are burned upwards of 5 pounds per day of mercury would be discharged into the atmosphere posing health and environmental hazards through mercury entering the food chain. U.S. Pat. No. 4,196,173 found that it was only practical to remove mercury from air in a bed of activated carbon of critical thickness and chlorine content. In U.S. Pat. No. 4,044,098, $H_2S$ was added to natural gas to precipitate the sulfides of mercury. The excess $H_2S$ was absorbed by a solvent. Technology for control of mercury emissions from such large sources as coal fired furnaces has not been developed although mercury has been observed in flue gas sulfur oxide scrubber effluent liquid. In one study, about 90% of the mercury in the fuel used for a large coal fired furnace was released and appeared as vapor discharged in the stack gas.

The partial oxidation process is a well known process for converting liquid hydrocarbonaceous and solid carbonaceous fuels into synthesis gas, reducing gas, and fuel gas. See coassigned U.S. Pat. Nos. 3,988,609; 4,251,228, and 4,436,530 for example, which are incorporated herein by reference. The removal of acid-gas impurities from synthesis gas is described in coassigned U.S. Pat. Nos. 4,052,175, and 4,081,253, which are incorporated herein by reference. However, the aforesaid references do not teach nor suggest the subject process for the production of demercurized synthesis gas, reducing gas, or fuel gas. By the subject process, the amount of mercury in synthesis gas, reducing gas, and fuel gas may be reduced to a safe level to avoid contaminating the atmosphere and catalysts, and to prevent possible health problems.

SUMMARY

The subject process relates to the production of demercurized synthesis gas, reducing gas, or fuel gas comprising:

(1) reacting a mercury-containing fossil fuel feed by partial oxidation with a free-oxygen containing gas with or without a temperature moderator in a reaction zone provided with a reducing atmosphere at a temperature in the range of about 982° C. to 1649° C. (1800° F. to 3000° F.) and a pressure in the range of about 10 atmospheres or higher to produce a raw effluent gas stream comprising $H_2$, CO, $H_2O$, $CO_2$, $H_2S$, COS, entrained slag and/or ash; and wherein substantially all of the mercury in the feed is converted into elemental mercury vapor which leaves the reaction zone entrained in the raw effluent gas stream;

(2) cooling, cleaning, and demoisturizing the raw effluent gas stream from (1);

(3) introducing the gas stream from (2) into a gas scrubbing zone where at a temperature in the range of about −50° C. to 80° C., such as about −40° C. to 40° C., say about −10° C. to 10° C., and a pressure of about 10 atmospheres or higher, said gas stream is contacted by a lean stream of gas scrubbing solvent thereby condensing about 20 to 100 wt. % of the mercury vapor and absorbing from about 90 to 100 wt. % of the sulfur-containing gases; and (4) removing the following streams from the gas scrubbing zone:

(a) a clean and demercurized stream of synthesis gas, reducing gas, or fuel gas containing about 0 to 80 wt. % of the mercury entering the gas scrubber;

(b) rich gas scrubbing solvent containing a major portion of the remaining mercury entering the gas scrubber entrained in condensed form and dissolved sulfur-containing gases; and (c) sludge or drainage containing the remainder of the mercury or its compounds in condensed form entering the gas scrubber.

In one embodiment, the clean and demercurized product gas stream was passed through a bed of activated carbon to produce a stream of mercury and sulfur-free synthesis gas, reducing gas, or fuel gas.

DESCRIPTION OF THE INVENTION

The fuel feedstock for the subject process comprises a mercury-containing fossil feed, such as a solid carbonaceous fuel containing about 0.01 to 1,000 parts per million of mercury. The mercury is in the form of elemental mercury and mercury compounds such as oxides, sulfides, chlorides, sulfates, nitrates, hydroxides, carbonates, acetates, and mixtures thereof. The solid carbonaceous fuel also contains sulfur-containing compounds e.g. sulfides of Fe, Zn, Cu, and Ca; and, it is selected from the group consisting of coal, coke from coal, and mixtures thereof. The coal may be anthracite, bituminous, lignite, and mixtures thereof. Waste material-containing mercury in the amount of about 1 to 25 wt. % (basis weight of feed) may be mixed with the solid carbonaceous fuel. For example, a mercury-containing inorganic and/or organic sludge from an industrial process may be mixed with a fossil fuel, such as liquid hydrocarbonaceous fuel, coal or other solid carbonaceous fuel.

By means of a conventional burner, such as shown and described in coassigned U.S. Pat. No. 4,443,230, which is incorporated herein by reference, mercury-containing fossil fuel feed is introduced into the reaction zone of a partial oxidation gas generator along with a stream of free-oxygen containing gas and optionally with a temperature moderator. The mercury-containing fossil fuel may be introduced into the reaction zone as a liquid slurry e.g. aqueous coal slurry, or as a dry feed e.g. pulverized coal entrained in a gaseous material, such as air, steam, nitrogen, $CO_2$, and recycle synthesis gas.

The free-oxygen containing gas is a member of the group consisting of air, oxygen-enriched air (22 mole % $O_2$ and higher), and preferably substantially pure oxygen (95 mole % $O_2$ and higher). The use of a liquid and gaseous temperature moderator is optional. For example, aqueous coal slurries feeds generally require no supplemental temperature moderator. Other temperature moderators for use with a dry fuel feed include steam, nitrogen, $CO_2$, and mixtures thereof.

The reaction zone is located in a vertical cylindrically shaped steel pressure vessel, such as shown in coassigned U.S. Pat. Nos. 2,809,104 and 4,637,823. The reaction zone comprises a down flowing free-flow refractory lined chamber with an centrally located inlet at the top and an axially aligned outlet in the bottom. Partial oxidation of the mercury-containing fossil fuel feed takes place in the reaction zone at an autogenous temperature in the range of about 982° C. to 1649° C., such as about 1200° C. to 1500° C., and at a pressure in the range of about 10 atmospheres or higher, such as at least 20 atmospheres, say about 20 to 80 atmospheres. The atomic ratio of free oxygen to carbon (O/C ratio) is in the range of about 0.6 to 1.6, such as about 0.8 to 1.4. The $H_2O$/fuel weight ratio is in the range of about 0.1 to 1.5, such as about 0.2 to 0.7.

The composition of the raw gas stream leaving the gas generator follows in mole %: $H_2$ 5 to 60, CO 30 to 60, $CO_2$ 2 to 25, $H_2O$ 2 to 20, $CH_4$ nil to 25, $NH_3$ nil to 1, $H_2S$ nil to 2, COS nil to 0.1, $N_2$ nil to 5.0, and Ar nil to 1.5. Further, entrained in the raw effluent gas stream from the reaction zone is molten slag and/or ash, and unexpectedly from about less than $1\times10^{-6}$ to $5\times10^{-4}$ mole % or more of mercury vapor. The mercury vapor was found to be thermodynamically stable even in the presence of $H_2S$ under the strong reducing conditions that prevailed in the gas generator and subsequent cooling. No new sulfides of mercury were formed. The vapor pressure of mercury is such that with the limited amounts of mercury entering the system, the outgoing raw effluent gas stream can carry the mercury in volatile form after when the gas is cooled and water scrubbed. While the propensity to form mercuric sulfide may increase as the temperature is lowered, elemental mercury is still thermodynamically the stable form at ambient temperature in the presence of the pressurized synthesis gas. Suitable gas generators provide for passing the hot raw effluent gas stream downward through the bottom outlet in the reaction zone and then downward through a radiant cooler where it is partially cooled and at least a portion of the entrained slag, ash, and particulate matter are removed. Alternatively, the hot raw effluent gas stream may be discharged downward through a central outlet in the bottom of the reaction zone followed by contacting the surface of or passing through a pool of quench water located below. These procedures will be described in greater detail below.

The hot raw effluent gas stream leaving the reaction zone containing mercury vapor is cooled cleaned, and demoisturized. For example, the hot effluent gas stream may be passed down through a radiant cooler located in a steel pressure vessel below the gasifier section. Molten slag and/or ash drop out of the gas stream and are cooled in a pool of quench water located at the bottom of the radiant cooler. By this means the effluent gas stream may be cooled to a temperature in the range of about 500° C. to 800° C. The partially cooled and deashed gas stream is then passed through at least one convection cooler, such as a conventional shell and tube heat exchanger, and cooled further to a temperature in the range of about 150° C. to 700° C. The gas stream is then scrubbed with water in a conventional gas scrubber, such as shown in coassigned U.S. Pat. No. 3,544,291, which is incorporated herein by reference. The gas stream is then dried by being cooled below the dew point in a conventional demoisturizer. The aforesaid scheme is further described in coassigned U.S. Pat. No. 4,436,530, which is incorporated herein by reference. For example, the $H_2O$ saturated process gas stream at a temperature in the range of about 100° C. to 300° C. may be passed in noncontact heat exchange with a coolant and cooled to a temperature in the range of about −50° C. to 80° C. in a liquid-vapor separator, or demoisturizer. Water condensate is separated from the dried process gas stream.

Alternatively, the hot raw effluent gas stream from the gasifier is cooled and cleaned by being passed through a dip tube which discharges the hot gas stream onto or into a pool of water contained in a quench tank located below the reaction zone. The gas stream is thereby cooled to a temperature in the range of about 100° C. to 300° C., and simultaneously the entrained molten slag and/or ash is scrubbed from the gas stream with water. For example, see coassigned U.S. Pat. No. 4,474,582, which is incorporated herein by reference. The saturated gas stream is optionally passed through a conventional first gas scrubber where it is scrubbed with water, such as previously described. The process gas stream is then cooled and demoisturized, as previously described. In one embodiment, the raw effluent gas stream from the reaction zone is cleaned by direct contact with water to produce a water dispersion comprising $H_2S$, $NH_3$, Hg, and ash and particulate solids. Said water dispersion is flashed and stripped to produce a flash gas stream comprising $H_2S$, $NH_3$ and a trace of Hg vapor which is introduced into an elemental sulfur recovery unit along with said other feed-streams.

The cooled, cleaned and demoisturized gas stream containing mercury vapor is introduced into a solvent gas scrubber where it is contacted with a lean solvent for the sulfur-containing gases in the process gas stream i.e. $H_2S$ and COS at a temperature in the range of about −50° C. to 80° C. and a pressure of about 10 atmospheres or higher. In the solvent gas scrubber, about 20 to 100 wt. % of the mercury vapor in the entering process gas stream is condensed and about 90 to 100 wt. % of the sulfur-containing gases are absorbed by the solvent gas scrubbing solvent. In one embodiment for example, the solvent gas scrubbing zone is operated at the same pressure as the partial oxidation reaction zone less ordinary pressure drop in the lines, and at a maximum temperature of about 20° C. Suitable gas scrubbing solvents include methanol, N-methyl-pyrrolidone, di and triethanolamine, and methyl diethanolamine. A demercurized and desulfurized product gas stream leaves from the solvent gas scrubber comprising $H_2$, CO, $H_2O$, mercury vapor, and optionally $CH_4$, $N_2$, and Ar. Depending on the gas composition, the product gas stream may be used as synthesis gas, reducing gas, or fuel gas.

The rich solvent and entrained condensed mercury are then introduced into a solvent recovery unit to be described further. A small portion of the mercury entering the solvent gas scrubber may leave as elemental Hg and/or mercuric sulfide in admixture with the sludge from the bottom of the solvent gas scrubber. The composition of the sludge will depend on the composition of the feedstock and on other upstream operating conditions. The sludge would contain FeS (from decomposition of $Fe(CO)_5$ in the acid gas scrubber) and trace amounts of fly ash still suspended in the process gas stream entering the acid gas scrubber plus possible breakdown products of the acid gas scrubber solvent. Anywhere from 0 to 100 wt. % of the mercury vapor entering the solvent scrubber leaves entrained in the demercurized product gas. The remainder of the mercury vapor entering the solvent scrubber leaves adsorbed in the rich solvent and/or as sludge. The wt. % range of mercury exiting with the desulfurized process gas stream will be highly dependent on (a) the amount of mercury originally in the sour process gas stream, and (b) the operating temperature of the acid gas scrubber. For example, with an acid gas scrubber operating at 0° C. or lower, the Hg content of the exit gas is about 0 to 20 wt. % of the Hg in the entering gas stream. However, if the acid gas scrubber is operated at a temperature in the range of about 40° C.–60° C., then the Hg content of the exit gas would rise to greater than about 50 wt. % of that in the entering gas stream.

The rich liquid solvent absorbent charged with mercury vapor and acid gas leaving the first solvent gas scrubber may be regenerated in a first solvent recovery zone to produce a sulfur-containing off-gas stream comprising $H_2S$, COS, $CO_2$, and mercury vapor. At least one and preferably a combination of the following conventional techniques may be used to regenerate the solvent: flashing, stripping with steam or an inert gas, and boiling. Heating and refluxing at reduced pressure may be used to produce a sulfur-containing off-gas stream comprising $H_2S$, COS, $CO_2$, and mercury vapor; and a stream of lean gas scrubbing solvent which is recycled to the gas scrubbing zone. For example, the stream of rich gas scrubbing solvent is regenerated by heating and refluxing at a temperature in the range of about 40° C. to 100° C. above the absorption temperature range and at a pressure in the range of about 1 to 2 atmospheres to produce a sulfur-containing off-gas stream comprising $H_2S$, COS, $CO_2$ and mercury vapor; and a stream of lean gas scrubbing solvent which may be recycled to the gas scrubbing zone. One or more absorbent regeneration columns may be used. In one embodiment, liquid methanol charged with $H_2S$ and COS leaving from the bottom of a regeneration column may be introduced into another regeneration column where, by hot regeneration of methanol, $H_2S$ and COS are boiled off. Thus, the charged methanol is heated to a temperature in the range of about 66° C. to 121° C. and a pressure in the range of about 10 to 100 psig, and the $H_2S$ and COS are boiled off. The stream of lean methanol may be then cooled to a temperature in the range of about −45° C. to −62° C. and recycled to said gas absorber. Optionally, an additional dehydration still for the lean methanol may be included in the system.

The stream of sulfur-containing gases and mercury leaving from the top of the last regeneration column in the first solvent recovery zone is mixed with sulfur-containing gas produced in a solvent regenerator for a tail gas volatile sulfur recovery unit, such as a Scot unit, and optionally with a stream of flash gas from stripping waste waters, to produce a rich sulfur-containing feed gas mixture to an elemental sulfur recovery unit, such as a Claus unit which comprises in mole %: $H_2S$ 10–40, COS nil to 3, $CO_2$ 60–90, and Hg vapor up to about 200 ppm. This stream of gases may be introduced into a conventional Claus unit where about $\frac{1}{3}$ of the initial $H_2S$ is oxidized with air to $SO_2$ at a temperature in the range of about 1000° C. to 1300° C. and a pressure in the range of about 1 to 10 atmospheres. The stoichiometry of the gas stream is such that the basic chemical reactions, for example, between the remaining $H_2S$ and $SO_2$, is shown in Equations I and II below.

$$2\ H_2S + SO_2 - 2\ SO_2 + 2H_2O \qquad \text{I}$$

$$2\ H_2S + SO_2 - 3S + 2H_2O \qquad \text{II}$$

Above the temperature range of 525° C.–625° C. no catalyst is required. Below this temperature range a catalyst e.g. bauxite is required to achieve satisfactory conversion rates. Elemental sulfur is produced in said Claus unit containing substantially no mercury. A separate tail gas stream is produced comprising $SO_2$, COS, $CO_2$, $CS_2$, and mercury vapor. In one embodiment, to prevent pollution of the atmosphere, the tail gas is incinerated to convert the residual $H_2S$ into $SO_2$. Any suitable commercially available process may be used to treat the incinerated Claus Plant tail-gas. For example, in the Scot process, at a temperature in the range of about 280° C. to 310° C., and a pressure in the range of about 1 to 10 atmospheres, the incinerated tail gas from the Claus unit is reacted with reducing gas e.g. $H_2$ or a mixture of CO and $H_2$ over a Co-Mo catalyst to reduce the $SO_2$ to $H_2S$ and to hydrolyze any COS and $CS_2$. In one embodiment, the mixture of $H_2+CO$ is a portion of the product reducing gas. $H_2$ may be produced by passing a portion of the mixture of $H_2+CO$ product gas over a water-gas shift catalyst and then removing $CO_2$ by means of a solvent gas scrubber. After cooling, the reduced gas is absorbed in lean aqueous diisopropanolamine (DIPA). In a second solvent recovery zone, the rich DIPA solution from a tail gas treating operation such as Scot Unit for the recovery of trace amounts of sulfur compounds from the tail gas from an elemental sulfur recovery process, such as a Claus Unit, may be regenerated with heat and the $H_2S$-containing gas may be returned to the front of the Claus process. An inert stripping gas e.g. $N_2$ may also be used. The lean DIPA solution is recycled to the Scot unit. The solvent scrubbed tail gas from the Scot unit containing trace amounts of mercury vapor, $CO_2$ and $H_2$ is passed through a bed of activated carbon at a temperature in the range of about −20° C. to 40° C., and a pressure in the range of about 0.5 to 5 atmospheres. Regenerating the bed of activated carbon by removing mercury will described below. A mercury and sulfur-free gas stream is produced comprising $CO_2$ and $N_2$ which may be discharged to the atmosphere. Alternatively, the solvent scrubbed Scot tail gas can be (1) cooled to condense and separate mercury, (2) compressed and cooled to separate the mercury, or (3) passed through a solution of nitric or sulfuric acid with potassium permanganate to oxidize the mercury to a non-volatile state.

The previously described demercurized synthesis gas, reducing gas or fuel gas which leaves from the top of the solvent gas scrubber may contain a residual amount of mercury vapor. In one embodiment, the demercurized gas stream at a temperature in the range of about −50° C. to 80° C. and a pressure in the range of about 10 to 80 atmospheres is contacted by an activated carbon sorbent and substantially all of the remaining mercury vapor and sulfur-containing gases, if any, are removed. The activated carbon sorbent by chemical and physical sorption can lower mercury pressure by a factor in the range of less than about 100 to 1,000. Thus, the ratio ps/pl is $<0.01$ and preferably $<0.001$ where ps is the equilibrium vapor pressure of Hg in the presence of the sorbent, and pl is the equilibrium vapor pressure of the liquid mercury at the same temperature. In another embodiment, the activated carbon is impregnated with highly dispersed gold to provide a wt. ratio of gold to carbon in the range of about 0.005 to 0.20. Hg and S-free synthesis gas, reducing gas or fuel gas is thereby produced. In one embodiment the demercurized gas stream is passed through a series of sorbent beds moving counter flow to the gas streams. By this means, the activated carbon treated process gas stream may contain less than 0.004 mg/$M^3$ of mercury.

The carbon sorbent may be regenerated by removing the mercury through heating to a temperature in the range of about 150° C. to 500° C. while stripping the sorbent with an inert gas e.g. nitrogen. In another embodiment the activated carbon sorbent bed is regenerated by the steps of (1) passing steam through the sorbent bed to produce a gaseous mixture of stream and mercury vapor, (2) cooling said gaseous mixture to condense the steam and mercury, (3) separating the mercury from the water, and (4) drying the activated carbon sorbent before reuse. For a more detailed discussion of conventional processes for the recovery of acid gases e.g. $CO_2$, $H_2S$, and COS, the Claus process, and the Scot process, reference is made to Kirk-Othmer, Encyclopedia of Chemical Technology, Third Edition 1983, John Wiley and Sons, Volume 22, pages 267–272 and 276 to 280, which is incorporated herein by reference.

DESCRIPTION OF THE DRAWING

A more complete understanding of the invention may be had by reference to the accompanying schematic drawing which shows an embodiment of the previously described process in detail.

Demercurized synthesis gas, reducing gas or fuel gas in line 1 is produced by the following process. The feed to partial oxidation reaction zone 2 comprises free-oxygen containing gas e.g. oxygen in line 3 and coal-water slurry in line 4. Reaction zone 2 is in a free-flow noncatalytic down-flowing steel pressure vessel or gasifier 5 lined with thermal refractory 6. Burner 7 is mounted in top central inlet 8 of gasifier 5 and comprises central passage 9, inner concentric coaxial annular passage 10, and outer concentric coaxial annular passage 11. The free-oxygen containing gas passes through lines 3, 15 and 16. It then passes through burner 7 into reaction zone 2 by way of central passage 9 and outer annular passage 11. Simultaneously, the coal-water slurry passes through inner annular passage 10 of burner 7 and mixes with the free-oxygen containing gas at the tip of the burner in the reaction zone.

The hot raw effluent gas stream produced in the reaction zone by the partial oxidation reaction is discharged through bottom axially aligned central outlet 17 and into radiant cooling zone 18 where a portion of the heat is removed by noncontact heat exchange with boiler feed water and steam. Radiant cooling zone 18 comprises a vertical cylindrically shaped steel pressure vessel 19 containing vertical annular shaped tube wall 20 provided with top and bottom headers 21 and 22 respectively, axially aligned centrally located bottom outlet 23 with discharge line 24, side outlet 25, and quench water bath 26. A portion of the slag, ash, and entrained particulate matter in the raw effluent gas stream drops out of the raw effluent gas stream and is quench cooled in the quench water bath 26 contained in the bottom of vessel 19. Periodically, slurries of quench water are removed by way of line 24 and are introduced into a conventional lock hopper and waste water reclaiming system (not shown).

The partially cooled and cleaned process gas stream is passed through side outlet 25 of vessel 19, gas transfer line 27, and then though side inlet 28 into ash separation chamber 29 in the bottom of convection gas cooler 30. Gas cooler 30 is a conventional shell and tube heat exchanger. The deashed partially cooled process gas stream is further cooled by being passed up through a plurality of spaced parallel vertical tubes 35 located in the upper section 36 of cooler 30. Ash and other solid matter that separates out from the gas stream in chamber 29 may be removed through bottom central axially aligned outlet 37 and line 38. The cooled gas stream passes out through central axially aligned outlet 39 and line 40. Cooling water enters upper section 36 through line 41, flows upwardly on the outside of tubes 35 and leaves through line 42. Final cleaning of the cooled gas stream with water takes place in a first gas scrubber 43. Water enters scrubber 43 by way of line 44. A dilute slurry leaves through line 45 and is directed to a water reclaiming facility (not shown).

The cooled and scrubbed gas stream leaves first gas scrubber 43 by way of line 50 and enters demoisturizer 51 where substantially all of the water in the gas stream is removed by conventional means. For example, the gas stream may be cooled below the dew point by heat exchange with a coolant which enters by way of line 52 and leaves by way of line 53. Condensed water is removed from demoisturizer 51 by way of line 54.

The cleaned dewatered process gas stream in line 55, with or without preheating depending on the solvent and the pressure, is introduced into solvent gas scrubber 56 where it is directly contacted with a suitable lean solvent. Mercury vapor in the process gas stream may be condensed. A mercury and sulfur-containing sludge is formed comprising droplets of mercury and iron and nickel sulfides. The Hg and S-containing sludge is removed through lines 57 at the bottom of solvent gas scrubber 56. A clean demercurized stream of synthesis gas, reducing gas, or fuel gas containing about 0 to 80 wt. % of the mercury entering solvent gas scrubber 56 is removed through line 1 at the top of solvent gas scrubber 56. In one embodiment, any remaining mercury is removed by passing the gas stream in line 1 through line 58, activated carbon bed 59, and lines 60 and 61. Hg in line 62 may be obtained by regenerating the activated carbon. For example, by the steps of passing steam through the activated carbon, condensing the steam and mercury vapor, and separating the Hg from the water, the carbon sorbent may be regenerated and reused. If there is no Hg and S in the demercurized product gas in line 1, activated carbon bed 59 may be by-passed by way of line 63.

The rich solvent leaving through line 68 at the bottom of solvent gas scrubber 56 is reactivated by conventional means. For example, steam heated reboiler 70 may by used to drive out from the rich solvent a tail gas comprising acid gases and mercury vapor in line 71. The lean solvent is then recycled to solvent gas scrubber 56 by way of line 72. A mercury-containing sludge is removed through line 73 at the bottom of solvent recovery zone 69. Alternatively, the rich solvent may be reactivated by means of a stripping gas e.g. $N_2$, with or without heat.

The stream of tail gas in line 71 is passed through line 74 and into conventional Claus unit 75 along with $H_2S$-containing recycle gas in line 76 from solvent recovery zone 77, and a stream of flash gas from line 78. The flash gas comprises $H_2S$, $NH_3$ and a trace of Hg vapor from stripping quench water dispersions comprising $H_2S$, $NH_3$, ash and particulate matter. Incineration of the feed streams with air from line 79 takes place in Claus unit 75. Substantially all of the $H_2S$ is converted in Claus unit 75 into Hg-free sulfur which leaves through line 80. A tail gas stream which leaves by way of line 81 is also produced comprising the sulfur-containing gases $SO_2$, COS, $CS_2$, and also $N_2$, and trace amounts of Hg. This gas stream is introduced into a conventional Scot unit 85 where it is incinerated with air from line 86. The incinerated tail gas in contact with a cobalt-molybdenum catalyst supported on alumina reacts with a reducing gas from line 87. The reducing gas may be a portion of the reducing gas from line 61. After cooling, the reduced gas is adsorbed in a lean stream of solvent comprising aqueous diisopropanolamine (DIPA) from line 88. The rich solvent in line 89 is introduced into solvent recovery zone 77 where it is regenerated by heat supplied by steam heated reboiler 90. In one embodiment, a stripping gas e.g. $N_2$ in lines 91, is introduced into solvent recovery zone 77.

The solvent scrubbed tail gas leaving Scot unit 85 through line 95 and comprising $CO_2$, $N_2$, and a trace of Hg vapor is passed through a bed of activated carbon 96. A stream of Hg-free $CO_2$ and $N_2$ is removed from carbon bed 96 by way of line 97. Activated carbon bed 96 is regenerated by passing steam (not shown) through it to vaporize the mercury. Upon cooling condensed Hg separates from the water and leaves by way of line 98.

Various modifications of the invention as herein before set forth may be made without departing from the spirit and scope thereof, and therefore, only such limitations should be made as are indicated in the appended claims.

I claim:

1. A process for the production of demercurized synthesis gas, reducing gas, or fuel gas comprising:

(1) reacting a mercury-containing fossil fuel feed by partial oxidation with a free-oxygen containing gas with or without a temperature moderator in a reaction zone provided with a reducing atmosphere at a temperature in the range of about 1800° F. to 3000° F. and a pressure in the range of about 10 atmospheres or higher to produce a raw effluent gas stream comprising $H_2$, CO, $H_2O$, $CO_2$, $H_2S$, COS, entrained slag and/or ash, and optionally $CH_4$, $NH_3$, $N_2$and Ar; and wherein substantially all of the mercury in the feed is converted into elemental mercury vapor which leaves the reaction zone entrained in the raw effluent gas stream;

(2) cooling, cleaning, and demoisturizing the raw effluent gas stream from (1);

(3) introducing the gas stream from (2) into a gas scrubbing zone where at a temperature in the range of about −50° C. to 80° C. and a pressure of about 10 atmospheres or higher, said gas stream is contacted by a stream of gas scrubbing solvent thereby condensing about 20 to 100 wt. % of the mercury vapor and removing from about 90 to 100 wt. % of the sulfur-containing gases; and (4) removing the following streams from the gas scrubbing zone:

(a) a clean and demercurized stream of synthesis gas, reducing gas, or fuel gas containing about 0 to 80 wt. % of the mercury entering the gas scrubber, (b) rich gas scrubbing solvent containing a major portion of the remaining mercury entering the gas scrubber entrained in condensed form; and (c) sludge or drainage containing the remainder of the mercury or its compounds in condensed form entering the gas scrubber.

2. The process of claim 1 wherein said reaction zone is a vertical downflowing free-flow refractory lined chamber with the reactants being introduced at the top by way of a burner, and with the raw effluent gas stream removed from the bottom of said chamber.

3. The process of claim 1 where in (2) the raw effluent gas stream from (1) is cooled to a temperature in the range of about −50° C. to 80° C. by heat exchange with at least one coolant.

4. The process of claim 1 wherein the raw effluent gas stream from (1) is cooled and cleaned by direct contact with water.

5. The process of claim 1 wherein the cooling, cleaning, and demoisturizing in (2) includes the steps of:

(a) passing the raw effluent gas stream from (1) through a radiant cooler where at least a portion of the entrained slag and/or ash separate out, and the effluent gas stream is cooled to a temperature in the range of about 500° C. to 800° C., by noncontact heat exchange with $H_2O$;

(b) scrubbing the cooled gas stream from (a) with water to remove particulate matter; and (c) cooling the partially cooled gas stream from (b) in at least one convection cooler to a temperature below the dew point, separating out water, and adjusting the temperature of the gas stream to about −50° C. to 80° C.

6. The process of claim 1 provided with the step of contacting the demercurized gas stream from (4)(a) with activated carbon sorbent, thereby removing substantially all of any remaining mercury vapor and sulfur-containing gas in the process gas stream.

7. The process of claim 1 wherein said gas scrubbing solvent is selected from the group consisting of methanol, N-methyl-pyrrolidone, di and triethanolamine, and methyl diethanolamine.

8. The process of claim 1 provided with the step of regenerating said stream of rich gas scrubbing solvent (4)(b) by at least one of the following process steps: flashing, stripping with steam or an inert gas, and heating and refluxing at reduced pressure to produce a sulfur-containing off-gas stream comprising $H_2S$, COS, $CO_2$, and mercury vapor; and a stream of lean gas scrubbing solvent; and recycling said stream of lean gas scrubbing solvent to the gas scrubbing zone in (3).

9. The process of claim 8 provided with the steps of:

(a) burning said sulfur-containing off-gas stream in an elemental sulfur recovery unit along with a recycle stream of $H_2S$-containing gas produced by regenerating the rich gas scrubbing solvent from a tail gas volatile sulfur recovery unit, and optionally a stream of flash gases, thereby producing in said elemental sulfur recovery unit elemental sulfur containing substantially no mercury, and a separate tail gas stream comprising $SO_2$, $CO_2$, $H_2S$, COS and;

(b) feeding said tail gas stream from the elemental sulfur recovery unit to said tail gas volatile sulfur recovery;

(c) withdrawing from said tail gas volatile sulfur recovery unit a solvent scrubbed gas stream comprising $CO_2$, $N_2$, and mercury vapor; and (d) contacting said exit gas stream from (c) with activated carbon to remove substantially all of said mercury vapor.

10. The process of claim 1 provided with the steps of cleaning the raw effluent gas stream from the reaction zone in (1) by direct contact with water to produce a water dispersion comprising $H_2S$, $NH_3$, Hg, and ash and particulate solids; flashing and stripping said water dispersion to produce a flash gas stream comprising $H_2S$, $NH_3$ and a trace of Hg vapor, and introducing said stream of flash gas into said elemental sulfur recovery unit along with said other feedstreams.

11. The process of claim 8 wherein said gas scrubbing solvent is regenerated in a stripping vessel being operated at a temperature of about 40° C. to 100° C. above the absorption temperature range and at a pressure in the range of about 1 to 2 atmospheres.

12. The process of claim 1 wherein said mercury-containing fossil fuel contains about 0.01 to 1000 ppm (parts per million) of mercury.

13. The process of claim 6 wherein said activated carbon treated process gas stream contains less than 0.004 mg/$M^3$ of mercury.

14. The process of claim 6 wherein said activated carbon is impregnated with highly dispersed gold to provide a wt. ratio of gold to carbon in the range of about 0.005 to 0.20.

15. The process of claim 6 wherein said carbon sorbent is regenerated by removal of mercury by heating to a temperature in the range of about 150° C. to 500° C. while stripping the sorbent with an inert gas e.g. nitrogen.

16. The process of claim 6 wherein said demercurized gas stream from (4)(a) is passed through a series of sorbent beds moving counter flow to the gas.

17. The process of claim 6 provided with the step of regenerating a sorbent bed by stripping mercury from the bed by passing steam through the sorbent bed, cooling the gaseous mixtures of $H_2O$ and mercury vapor and separating condensed mercury from condensed steam, and drying the sorbent before reuse.

18. The process of claim 1 wherein said mercury-containing fossil fuel is a solid carbonaceous fuel containing about 0.01 to 1000 parts per million of mercury.

19. The process of claim 18 wherein said solid carbonaceous fuel is selected from the group consisting of coal, coke from coal and mixtures thereof.

20. The process of claim 19 wherein said coal is selected from the group consisting of anthracite, bituminous, lignite, and mixtures thereof.

21. The process of claim 1 wherein a waste material-containing mercury is in admixture with said fossil fuel.

22. The process of claim 21 wherein said waste material-containing mercury is a mercury-containing inorganic and/or organic sludge from an industrial process.

23. The process of claim 1 wherein said partial oxidation reaction zone in (1) is operated at a pressure of at least 10 atmospheres, and the gas scrubbing zone in (3) is operated at substantially the same pressure as the reaction zone in (1) less ordinary pressure drop in the lines, and at a maximum temperature of about 20° C.

24. A process for the production of demercurized synthesis gas, reducing gas, or fuel gas comprising:

(1) reacting a mercury-containing fossil fuel feed comprising solid carbonaceous fuel containing about 0.01 to 1000 ppm (parts per million) of mercury by partial oxidation with a free-oxygen containing gas with or without a temperature moderator in a reaction zone provided with a reducing atmosphere at a temperature in the range of about 1800° F. to 3000° F. and a pressure in the range of about 10 atmospheres or higher to produce a raw effluent gas stream comprising $H_2$, CO, $H_2O$, $CO_2$, $H_2S$, COS, entrained slag and/or ash, and optionally $CH_4$, $NH_3$, $N_2$ and Ar; and wherein substantially all of the mercury in the feed is converted into elemental mercury vapor which leaves the reaction zone entrained in the raw effluent gas stream;

(2) cooling, cleaning, and demoisturizing the raw effluent gas stream from (1); wherein said cooling, cleaning and demoisturizing includes the steps of:

(a) passing the raw effluent gas stream from (1) through a radiant cooler where at least a portion of the entrained slag and/or ash separate out, and the effluent gas stream is cooled to a temperature in the range of about 500° C. to 800° C., by non-contact heat exchange with $H_2O$;

(b) cooling further the partially cooled gas stream from (a) in at least one convection cooler and scrubbing gas stream with water to remove entrained particulate matter;

(c) demoisturizing the cooled and cleaned gas stream from (b);

(3) introducing the gas stream from (2)(c) into a solvent gas scrubbing zone where at a temperature in the range of about −50° C. to 80° C. and a pressure of about 10 atmospheres or higher, said gas stream is contacted by a stream of gas scrubbing solvent thereby condensing about 20 to 100 wt. % of the mercury vapor and removing from about 90 to 100 wt. % of the sulfur-containing gases; and (4) removing the following streams from the solvent gas scrubbing zone:

(a) a clean and demercurized stream of synthesis gas, reducing gas, or fuel gas containing about 0 to 80 wt. % of the mercury entering the gas scrubber, and contacting said demercurized gas stream with activated carbon sorbent, thereby removing substantially all of any remaining mercury vapor and sulfur-containing gas in the process gas stream;

(b) rich gas scrubbing solvent containing a major portion of the remaining mercury entering the gas scrubber entrained in condensed form, and regenerating said stream of rich gas scrubbing solvent by at least one of the following process steps: flashing, stripping with steam or an inert gas, or heating and refluxing at a temperature in the range of about 40° C. to 100° C. above the absorption temperature range and at a pressure in the range of about 1 to 2 atmospheres to produce a sulfur-containing off-gas stream comprising $H_2S$, COS, $CO_2$, and mercury vapor; and a stream of lean gas scrubbing solvent; and recycling said stream of lean gas scrubbing solvent to the gas scrubbing zone in (3); and (c) sludge or drainage containing the remainder of the mercury or its compounds in condensed form entering the gas scrubber.

25. The process of claim 24 wherein said solid carbonaceous fuel is selected from the group consisting of coal, coke from coal and mixtures thereof.

26. The process of claim 25 wherein said coal is selected from the group consisting of anthracite, bituminous, lignite, and mixtures thereof.

27. The process of claim 24 wherein said mercury-containing fossil fuel comprises a waste material-containing mercury in admixture with a fossil fuel.

28. The process of claim 27 wherein said waste material-containing mercury is a mercury-containing inorganic and/or organic sludge from an industrial process.

29. The process of claim 24 wherein said partial oxidation reaction zone in (1) is operated at a pressure of at least 10 atmospheres, and the gas scrubbing zone in (3) is operated at the same pressure as the reaction zone in (1) less ordinary pressure drop in the lines, and at a maximum temperature of about 20° C.

* * * * *